US008478176B2

(12) United States Patent
Tagami

(10) Patent No.: US 8,478,176 B2
(45) Date of Patent: Jul. 2, 2013

(54) FIXING APPARATUS

(75) Inventor: Kenichi Tagami, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 297 days.

(21) Appl. No.: 13/031,981

(22) Filed: Feb. 22, 2011

(65) Prior Publication Data

US 2011/0206424 A1 Aug. 25, 2011

(30) Foreign Application Priority Data

Feb. 22, 2010 (JP) ..... 2010-035532

(51) Int. Cl.
*G03G 15/20* (2006.01)

(52) U.S. Cl.
USPC ..... 399/322; 399/122; 399/320; 399/400

(58) Field of Classification Search
USPC ..... 399/122, 320, 322, 400
See application file for complete search history.

(56) References Cited

U.S. PATENT DOCUMENTS

| | | | | |
|---|---|---|---|---|
| 6,754,458 | B2 | 6/2004 | Makihira | |
| 6,950,618 | B2 | 9/2005 | Shimizu et al. | |
| 7,333,764 | B2 * | 2/2008 | Chung | 399/400 |
| 7,751,766 | B2 * | 7/2010 | Tsunoda | 399/322 |
| 2002/0186986 | A1 | 12/2002 | Makihira | |
| 2004/0052548 | A1 | 3/2004 | Shimizu et al. | |
| 2008/0226343 | A1 * | 9/2008 | Jeon et al. | 399/122 |
| 2011/0052260 | A1 * | 3/2011 | Sawamura et al. | 399/122 |
| 2011/0142504 | A1 * | 6/2011 | Kang et al. | 399/322 |
| 2011/0236067 | A1 * | 9/2011 | Ichiki et al. | 399/122 |

FOREIGN PATENT DOCUMENTS

| | | |
|---|---|---|
| JP | 10-240099 | 9/1998 |
| JP | 2002-323822 | 11/2002 |
| JP | 2003-140480 | 5/2003 |
| JP | 2004-157511 | 6/2004 |
| JP | 2006-047593 | 2/2006 |
| JP | 2006-182465 | 7/2006 |

* cited by examiner

*Primary Examiner* — Ryan Walsh
(74) *Attorney, Agent, or Firm* — Fitzpatrick, Cella, Harper & Scinto

(57) ABSTRACT

A fixing apparatus fixes an image formed on a recording material and includes a guiding member for guiding movement of the recording material, provided in a recording material passing opening of the apparatus, a rib projecting from a recording-material passing surface of the guiding member, for being contacted by the recording material, a shutter provided at a position opposing the guiding member and movable between a position for opening the passing opening and a position closing the passing opening, and a projection provided at a position of the shutter opposing a portion of the guiding member not having the rib with respect to a direction perpendicular to a recording material feeding direction. When the shutter takes the closing position, the clearance between the rib and the shutter is larger than the clearance between the guiding member and the projection.

2 Claims, 6 Drawing Sheets

A – A

B – B

FIXING APPARATUS

FIELD OF THE INVENTION AND RELATED ART

The present invention relates to a fixing apparatus which is employable by an electrophotographic image forming apparatus.

Some conventional image forming apparatuses which are equipped with a fixing apparatus are provided with a shutter for keeping closed the openings of the recording-medium conveyance passage of the fixing apparatus, in order to prevent a user from touching the interior of the fixing apparatus when the user installs a process cartridge into the main assembly of the image forming apparatus, or removes a process cartridge from the main assembly, and also, when the user deals with a paper jam or the like problems. For example, in the case of the image forming apparatus disclosed in Japanese Laid-open Patent Application 2002-323822, the main assembly of the image forming apparatus is provided with a door for allowing a user (operator) to access the interior of the image forming apparatus, and its fixing apparatus is provided with a shutter which is rotationally moved by the opening and closing movement of the door of the main assembly. During an image forming operation, the shutter is kept in a position in which it keeps open the recording-material passage of the fixing apparatus, whereas during a period in which the door of the main assembly of the image forming apparatus is open, for example, during a period in which the user deals with a paper jam or the like, the shutter is kept in a position in which it keeps shut the recording-medium conveyance passage of the fixing apparatus, in order to prevent the user from touching the fixation film and the pressure roller in the fixing apparatus while the user is dealing with the a paper jam or the like.

More specifically, as the shutter is moved into its closed position, its comes into contact with stoppers which are outside the recording-medium passage, in terms of the direction perpendicular to the recording medium conveyance direction, being thereby properly positioned to keep closed the recording-medium conveyance passage of the fixing apparatus. Further, the fixing apparatus is structured so that when the shutter is in its closed position, there is a space between the portion of the shutter, which corresponds in position to the recording-medium conveyance passage of the fixing apparatus, and the recording-medium conveyance guide of the fixing apparatus; the portion of the shutter, which corresponds in position to the recording-medium conveyance passage of the fixing apparatus, is prevented from coming into contact with the recording-medium conveyance guide. However, the shutter is sometimes bent or warped by external force when it is closed or in its closed position. Further, the shutter itself may naturally bend or warp, or may be made to bend or warp by the components related to the shutter. In the case of the conventional fixing apparatus provided with the above-described shutter, therefore, the recording-medium guiding surface (which comes into contact with recording medium) of the recording-medium conveyance guide is sometimes damaged. If the portions of the recording-medium guide of the fixing apparatus, which come into contact with recording medium, are damaged, the accuracy with which the fixing apparatus can convey recording medium is likely reduced. For example, it is likely to suffer from a paper jam or the like problems. Obviously, these problems can be prevented by such measures as increasing the shutter and the components related to the shutter in dimensional accuracy, and/or increasing the shutter and the components related to the shutter in rigidity, in order to prevent the shutter from bending or warping. These methods, however, invite increase in fixing-apparatus cost and image-forming-apparatus cost.

SUMMARY OF THE INVENTION

The present invention was made in consideration of the problems described above. Thus, the primary object of the present invention is to provide a fixing apparatus, the shutter of which does not damage the recording-medium guiding surface of the recording medium guide of the fixing apparatus, which faces the shutter, when the shutter is closed or in its closed position, and yet, which is no higher in cost than any of conventional fixing apparatuses.

According to an aspect of the present invention, there is provided a fixing apparatus for fixing an image formed on a recording material. The fixing device comprises a guiding member for guiding movement of the recording material, provided in a recording material passing opening of the apparatus, a rib projecting from a recording material passing surface of the guiding member, for being contacted by the recording material, a shutter provided at a position opposing the guiding member and movable between a position for opening the passing opening and a position closing the passing opening, and a projection provided at a position of the shutter opposing a position of the guiding member not having the rib with respect to a direction perpendicular to a recording-material feeding direction. When the shutter takes the closing position, a clearance between the rib and the shutter is larger than a clearance between the guiding member and the projection.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

General Structure of Image Forming Apparatus

Hereinafter, the image forming apparatus in one of the preferred embodiment of the present invention is described, with the reference to the appended drawings.

Figure 1:
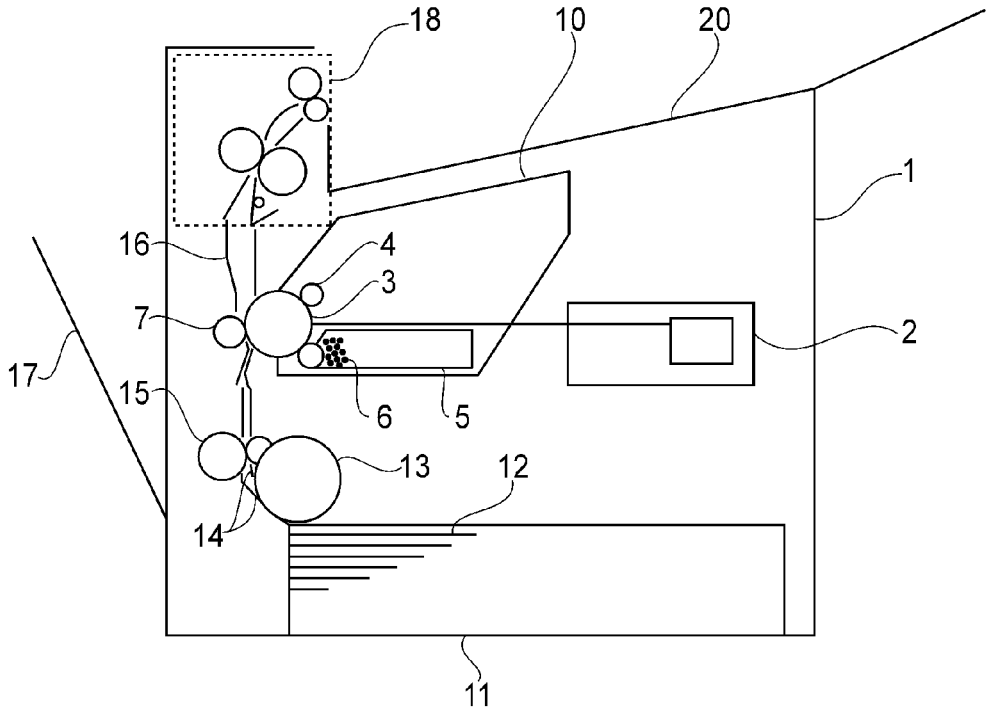
FIG. 1 is a schematic sectional view of a laser beam printer, that is, an example of an image forming apparatus, and shows the general structure of the printer.
Figure 8:
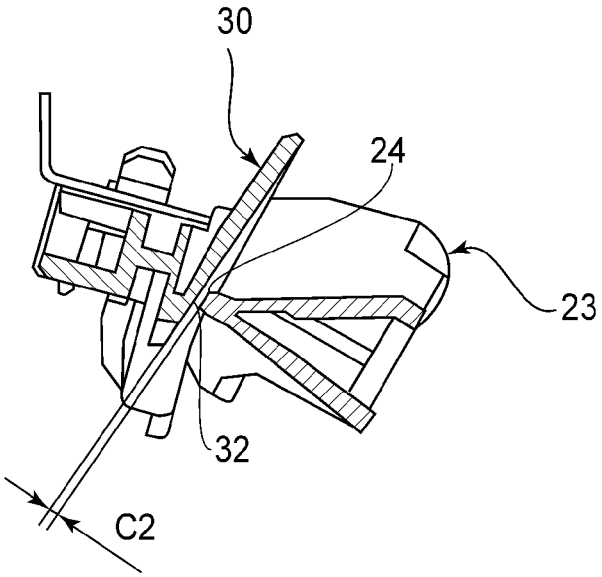
FIG. 8 is a detailed sectional view of the entrance guide and shutter of the fixing apparatus, at a plane B-B in FIG. 6, and shows Clearance C2 of the fixing apparatus.

FIG. 8 is a schematic sectional view of the image forming apparatus equipped with a fixing apparatus in accordance with the present invention, and shows the general structure of the image forming apparatus. Referring to FIG. 1, the image forming apparatus 1 has a scanner unit 2, that is, an optical means, which scans the peripheral surface of an image bearing member (photosensitive drum 3) with beams of laser light which it projects while modulating the beam with signals in accordance with the information of an image to be formed. Designated by reference numeral 10 is a process cartridge which contains an image forming means, which includes a photosensitive drum 3 (image bearing member), and a charging device 4 of the roller type (the roller is made up of semiconductive rubber). The process cartridge 10 has also a developing apparatus 5 and a cleaner, which also are integral parts of the process cartridge 10. The developing apparatus 5 develops an electrostatic latent image on the photosensitive drum 3, by transferring toner 6 onto the peripheral surface of the photosensitive drum 3. The cleaner removes the waste toner from the peripheral surface of the photosensitive drum 3.

As the photosensitive drum 3 in the process cartridge 10 is rotated, the peripheral surface of the photosensitive drum 3 is uniformly charged by the charging device 4 of the roller type. Then, an electrostatic latent image is formed on the peripheral surface of the photosensitive drum 3 by the beam of laser light projected upon the peripheral surface of the photosensitive drum 3 by the scanner unit 2. Then, the electrostatic latent image is developed by the developing apparatus 5; the latent image is supplied with toner by the developing apparatus 5, whereby a visible image, which reflects the latent image, is formed of the toner, on the peripheral surface of the photosensitive drum 3.

There are multiple sheets 12 of a recording medium in a sheet feeder cassette 11. The sheets are stored in layers in the cassette 11. The sheets 12 of the recording medium are sheets of paper, for example, and are roughly 64-216 g in basis weight. Each sheet 12 of the recording medium in the cassette 11 is fed into the main assembly of the image forming apparatus by a feed roller 13, while being separated one by one from the rest by the feed roller 13. After being fed into the main assembly, each sheet 12 of the recording medium is conveyed to a pair of registration rollers 15 while being guided by top and bottom guides. The registration rollers 15 remain stationary until the arrival of the sheet 12 of the recording medium (until the sheet 12 is pressed upon registration rollers 15). Thus, as the leading edge of the sheet 12 of the recording medium comes into contact with the registration rollers 15, the sheet 12 is made to correct itself in angle by the registration rollers 15.

Then, the registration rollers 15 convey the sheet 12 of the recording medium to the transfer portion in such a manner that the leading edge of the image bearing area of the sheet 12 arrives at the transfer portion of the image forming apparatus 1 at the same time as the leading edge of the toner image formed on the peripheral surface of the photosensitive drum 3 arrives at the transfer portion. Incidentally, the image forming apparatus 1 is provided with a sensor (unshown), which is in the adjacencies of the pair of registration rollers 15 and detects the state of conveyance of the sheet 12, detecting for example, a recording-medium jam (paper jam), and the length of the sheet 12.

After the sheet 12 of the recording medium is conveyed to the transfer portion, it is conveyed through the transfer portion while electric charge, which is opposite in polarity from the toner, is applied to the back surface of the sheet 12 (opposite surface of the sheet 12 from the photosensitive drum 3) by a transfer roller 7. Thus, the toner image on the photosensitive drum 3 is transferred onto the sheet 12 as the sheet 12 is conveyed through the transfer portion. After the transfer of the toner image onto the sheet 12 in the transfer portion, the sheet 12 is conveyed to a fixing apparatus 18 (fixing means) while being guided by a sheet guide 16. The fixing apparatus 18 fixes the unfixed toner image on the sheet 12 by applying heat and pressure to the toner image and sheet 12. After the fixation of the toner image to the sheet 12, the sheet 12 is discharged into a delivery tray 20. Designated by reference numeral 17 is a door for allowing a user (operator) of the image forming apparatus 1 to access the interior of the apparatus 1 when the apparatus 1 becomes jammed with the sheet 12 of the recording medium or the like. Thus, the door 17 coincides in position to the portions of the recording-medium passages, which are prone to experience a recording-medium jam or the like.

<Fixing Apparatus>

Next, referring to FIGS. 2-6, the aforementioned fixing apparatus 18 is described.

Figure 2:
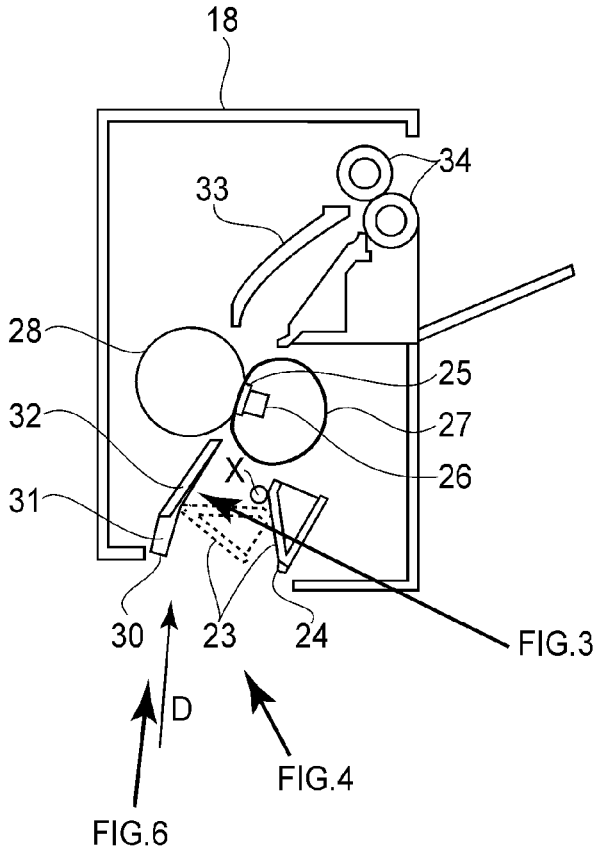
FIG. 2 is an enlarged sectional view of the fixing apparatus 18.

FIG. 2 is a schematic sectional view of the fixing apparatus 18, and shows the structure of the apparatus 18. This fixing apparatus 18 has: a fixation film 27; a pressure roller 28; and a heater (ceramic heater) 25 which is in contact with the inward surface of the fixation film 27. The fixing apparatus 18 has also: a thermistor 26 which detects the temperature of the heater; and an entrance guide (guiding member) 30 as a means for guiding a sheet of the recording medium into the fixing apparatus 18. The entrance guide 30 is at the sheet entrance of the recording-medium passage of the fixing apparatus 18, and guides a sheet of the recording medium as the sheet enters the fixing apparatus 18. The fixing apparatus 18 has also a shutter 23, which is on the opposite side of the recording-medium passage from the entrance guide 30, that is, the portion of the fixing apparatus 18, through which a sheet of the recording medium is introduced into the fixing apparatus 18 along a sheet guide 16. The shutter 23 is rotatable about an axis X. The position of the shutter 23, which is indicated by a solid line in FIG. 2, is where the shutter 23 is when the recording-medium entrance of the fixing apparatus 18 is open, and the position of the shutter 23, which is indicated by dotted line FIG. 2, is when the recording medium entrance is closed. An arrow mark D indicates the direction in which a sheet of the recording medium is conveyed. Designated by reference numeral 33 is a guide for guiding a sheet 12 of the recording medium after fixation. Designated by a reference numeral 34 is a pair of rollers for conveying a sheet 12 of the recording medium into the delivery tray 20.

The fixation film 27 is a thin endless belt, and is formed of polyimide, SUS, or the like. It is 20 mm in external circumference, and 60 μm in thickness. Thus, it is low in thermal capacity, being therefore enabled to be quickly increased in temperature. In order to make it easier for a sheet 12 of the recording medium to be parted from the fixation film 27, the substrate layer of the film 27, which is made up of polyimide, SUS, or the like, is covered with a parting layer on the outward side.

The pressure roller 28 is made up of a metallic core and an elastic surface layer. The metallic core is made of iron, stainless steel, or the like substance. The surface layer is cylindrical and covers virtually entirety of the peripheral surface of the metallic core. It is made of solid or foamed silicone rubber.

Figure 3:
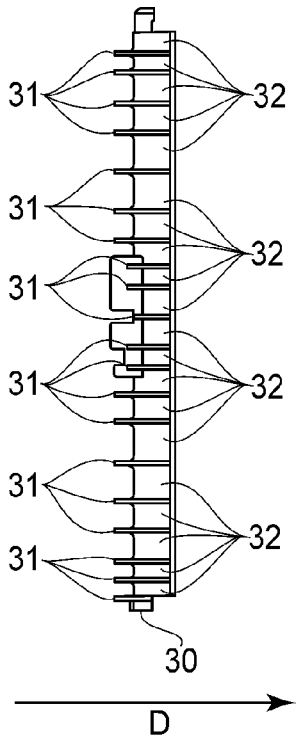
FIG. 3 is a plan view of the entrance guide of the fixing apparatus, as seen from the direction indicated by an arrow mark in FIG. 2.

The entrance guide 30 is formed of a moldable substance or the like. FIG. 3 is a plan view of the guide 30 (shown in FIG. 2) as seen from the upstream side of the recording-medium conveyance direction. Referring to FIG. 3, the entrance guide 30 has: a flat portion 32; and multiple ribs 31 (conveyance ribs) which project from the flat portion 32 in the direction perpendicular to the flat surface of the flat portion 32, and also, in the direction parallel to the recording-medium conveyance direction. The ribs 31 are parallel to each other. In other words, the entrance guide 30 is roughly in the form of a comb. The sheet 12 of the recording medium, which hereafter may be referred to simply as a sheet 12, is conveyed into the fixing apparatus 18 in the direction indicated by an arrow mark D. While the sheet 12 is conveyed into the fixing apparatus 18, it comes into contact with the ribs 31, but, does not with the flat portion 32. These ribs 31 are positioned so that when the shutter 23 is in its closed position, that is, the position in which the shutter 23 is closest to the entrance guide 30, the ribs 31 face the base portion 29 of the shutter 23 (which will be described later), which does not have projection 24.

Figure 4:
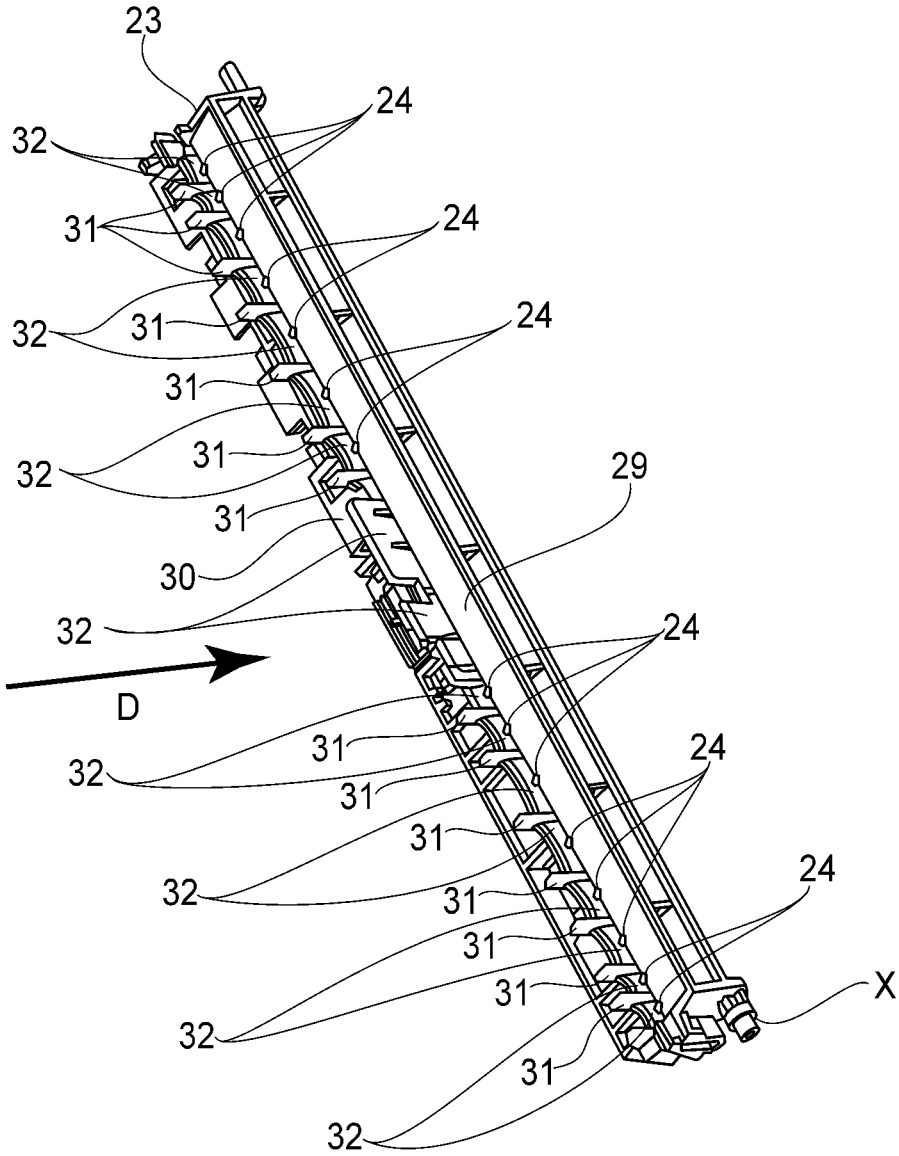
FIG. 4 is a perspective view of the entrance guide and shutter of the fixing apparatus.

FIG. 4 is a perspective view of the guide 30 and shutter 23 (when the shutter 23 is in its closed position, being smallest in its distance from guide 30). The shutter 23 also is formed of a moldable substance or the like. The main portion of the shutter 23 is long and narrow. The shutter 23 has multiple projections 24 (equivalent to ribs of guide 30), which project from the base portion 29 of the shutter 23. The positioning of these projections 24 is such that when the shutter 23 is in its closest position to the entrance guide 30, the projections 24 face the flat portion 32 of the entrance guide 30. That is, in terms of the direction perpendicular to the recording-medium conveyance direction, the projections 24 are on the portions of the shutter 23, which correspond in position to the portions of the guiding member 30, which do not have the rib 31. Further, it is desired that the projections 24 are positioned so that when the shutter 23 is in its closed position, they are in the adjacencies of the ribs 31 of the entrance guide 30, one for one.

The height of each projection 24 from the base portion 29 of the shutter 23 is greater than the height of each rib 31 from the flat portion 32 of the guide 30.

Figure 5:
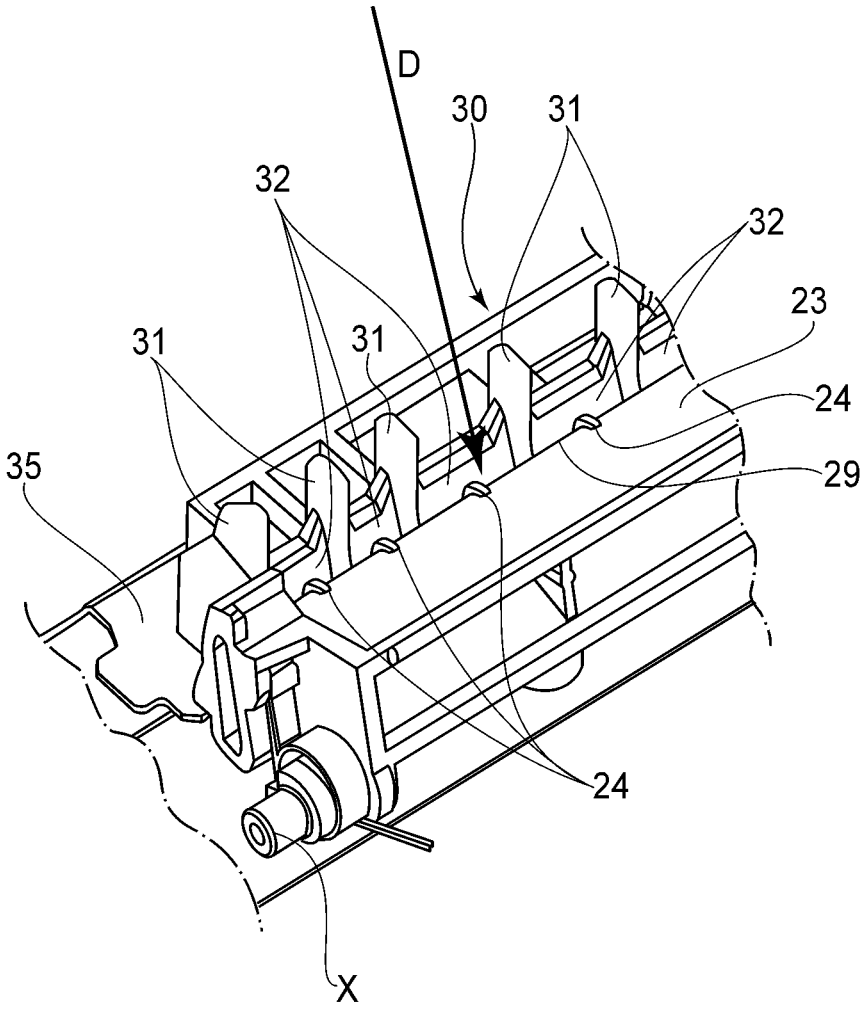
FIG. 5 is a detailed perspective of the stopper portion of the fixing apparatus.
Figure 6:
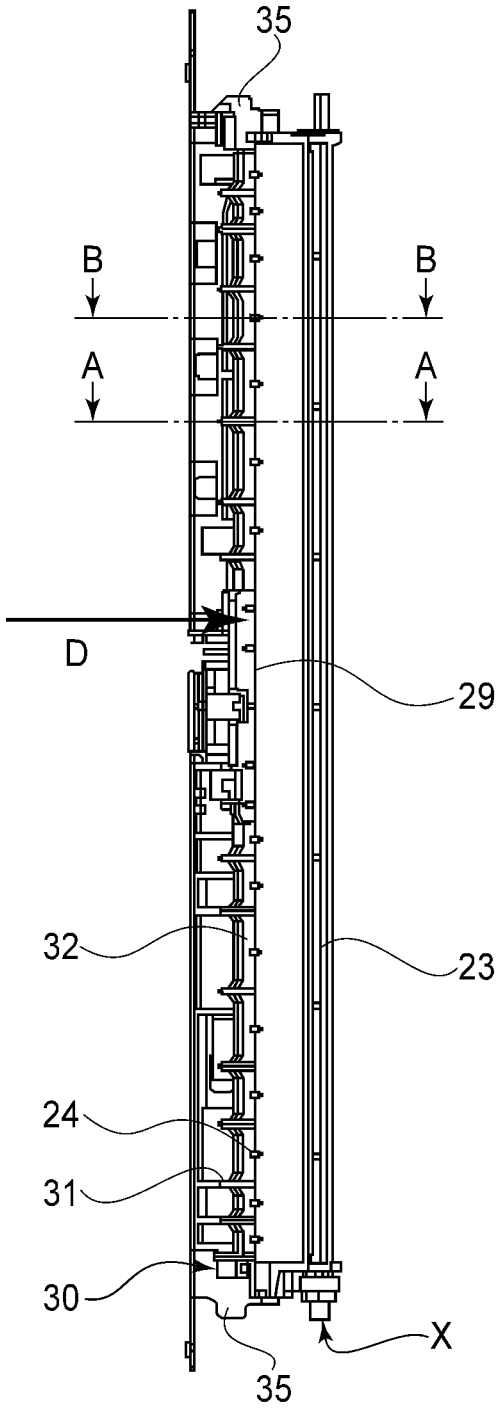
FIG. 6 is a detailed plan view of the entrance guide and shutter of the fixing apparatus, as seen from the upstream side of the fixing apparatus in terms of the recording-medium conveyance direction.

Next, referring to FIGS. 5 and 6, the main frame is provided with a pair of stoppers 35 (shutter positioning portions), which are on the outward sides of the guide 30, one for one, in terms of the lengthwise direction of the guide 30. The stoppers 35 are the portions of the main frame, with which the lengthwise ends of the shutter 23 come into contact as the shutter 23 is closed. Each stopper 35 is in the form of a piece of flat plate. Further, the stoppers 35 are outside the passage of the recording medium sheet 12 in terms of the lengthwise direction of the guide 30. That is, in terms of the direction perpendicular to the recording-medium conveyance direction, there are shutter positioning portions, which are outside the recording-medium conveyance passage, and which properly position the shutter 32 as the shutter 23 is moved into the position in which the shutter 23 keeps the recording-medium conveyance passage shut.

<Movement of Fixing Apparatus Shutter>

Next, the movement of the shutter 23 of the fixing apparatus 18 is described.

While the image forming apparatus 1 is forming images, the recording medium sheet 12 is sent to the fixing apparatus 18 after the transfer of a toner image onto the sheet 12. As heat is applied to the sheet 12 and the toner image thereon by the fixing apparatus 18, the toner image becomes semi-permanently fixed to the sheet 12. After the sheet 12 comes out of the fixation nip, the sheet 12 is conveyed along the guide 33 by the pair of discharge rollers 34, and is discharged into the delivery tray 20, by the pair of discharge rollers 34.

While the recording medium sheet 12 is conveyed through the fixing apparatus 18, the fixing apparatus 18 keeps its recording-medium conveyance passage open by keeping its shutter 23 in the position outlined by the solid line in FIG. 2.

On the other hand, when a user has to deal with a paper jam or the like problem, the user is to open the door 17 of the image forming apparatus 1, shown in FIG. 1, and access the jammed paper in the recording-medium conveyance passage. The image forming apparatus 1 and its fixing apparatus 18 are structured so that as the use opens the door 17, the shutter 23 of the fixing apparatus 18 is moved into its closed position outlined by the dotted line in FIG. 2, by the movement of the door 17, whereby the fixation film 27 and the pressure roller 28 are prevented from being touched by the user while a paper jam or the like problem is dealt with. As the user closes the door 17, the shutter 23 is moved back into its open position by the movement of the door 17.

Figure 7:
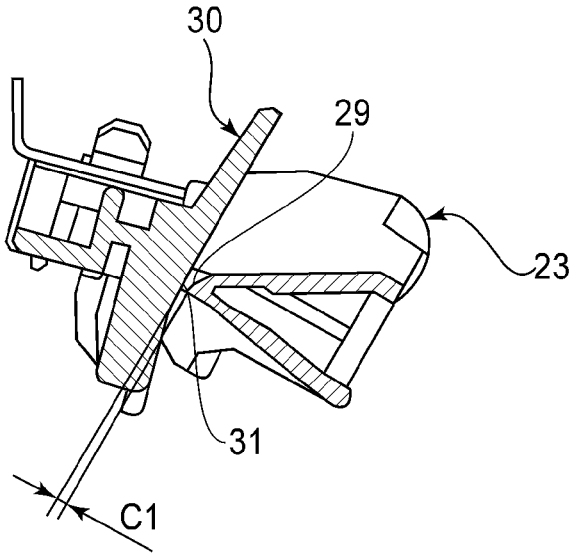
FIG. 7 is a detailed sectional view of the entrance guide and shutter of the fixing apparatus, at a plane A-A in FIG. 6, and shows Clearance C1 of the fixing apparatus.

FIG. 6 is a plan view of the entrance guide and shutter of the fixing apparatus 18, as seen from the upstream side of the fixing apparatus in terms of the recording-medium conveyance direction. FIG. 7 is a sectional view of the entrance guide and shutter of the fixing apparatus 18, at a plane A-A in FIG. 6, which coincides in position with one of the ribs 31 and is perpendicular to the lengthwise direction of the fixing apparatus 18 (perpendicular to the recording-medium conveyance direction). FIG. 8 is a sectional view of the entrance guide and shutter of the fixing apparatus, at a plane B-B in FIG. 6, which coincides in position with one of the projection 24 of the shutter 23. First, referring to FIG. 6, as the shutter 23 is closed, the lengthwise end portions of the shutter 23 come into contact with the stoppers 35 which are outside the recording-medium passage, whereby the shutter 23 is properly positioned in its closed position. Next, referring to FIG. 7, the fixing apparatus 18 is structured so that when the shutter 23 is in its closed position, there is a clearance C1 (space) between each rib 31 of the entrance guide 30 and the base portion of the shutter 23.

Next, referring to FIG. 8, the fixing apparatus 18 is structured so that when the shutter 23 is in its closed position, there is a clearance C2 (space) between each of the projection 24 of the shutter 23, and the flat portion 32 of the entrance guide 30.

In a case where the shutter 23 has been bent or warped by external force or the like, as the shutter is rotationally moved into its closed position, the projections 24 of the shutter 23 come into contact with the flat portion 32 (which faces shutter 23) of the entrance guide 30, whereby the shutter 23 is prevented from being rotationally moved further.

Here, the height of each of the projections 24 of the shutter 23 from the base portion 29 of the shutter 23 is greater than the height of the each of the ribs 31 of the flat portion 32 of the guide 30, as described previously. Further, the fixing apparatus 18 is structured so that Clearance C1 is greater than Clearance C2 (C1>C2), as shown in FIGS. 7 and 8. That is, when the shutter 23 is in its position in which it keeps closed the entrance of the recording-medium passage, Clearance C1, that is, the gap between the rib 31 and shutter 23, is greater than Clearance C2, that is, the gap between the guide 30 and projection 24. Therefore, even if the shutter 23 will have deformed and caused its projections 24 to come into contact with the flat portion 32 of the guide 30, there will still remain a gap between the ribs 31 and base portion 29. Therefore, it does not occur that the ribs 31 are damaged by the contact between the ribs 31 (with which sheet 12 of the recording medium comes into contact) and shutter 23. Therefore, the shutter 23 can fulfill its function as a shutter. As for the flat portion 32 of the guide 30, it is the portion with which the sheet 12 of recording medium is unlikely to come into contact. Therefore, even if the flat portion 32 happens to be damaged by the projections 24, the portion (tip) of each rib 31, which comes into contact with the sheet 12, is protected. Therefore, the fixing apparatus 18 is prevented from suffering from such problems that cause a reduction in the accuracy with which the fixing apparatus 18 conveys the sheet 12 through the fixing apparatus 18, which can cause, for example, the problem that the fixing apparatus 18 is likely to be jammed with the sheet 12 of the recording medium.

Further, the shutter 23 is provided with the multiple projections 24. Therefore, if the shutter 23 happens to bend or warp, the shutter 23 is properly supported (at multiple points). In other words, even if the shutter 23 is relatively easily bent in the direction perpendicular to its lengthwise direction, it is possible for the shutter 23 to perform its primary function. Moreover, it is unnecessary for the shutter 23 to be provided with a metallic reinforcement stay or the like for preventing the shutter 23 from bending or warping. Therefore, the shutter 23 may be formed of inexpensive moldable substance. Further, it is unnecessary to increase the shutter 23 in dimensional accuracy in order to prevent the shutter 23 from warping. In other words, the present invention can reduce the shutter 23 in cost.

Further, when the shutter 23 is stationary in its closed position, its projections 24 are in contact with the flat portion 32 of the guide 30. Therefore, it is ensured that even if the shutter 23 warps substantially, the ribs 31 are not going to be damaged.

Incidentally, in this embodiment of the present invention, the shutter 23 was in the adjacencies of the recording-medium entrance of the fixing apparatus 18. However, this embodiment is not intended to limit the present invention in scope. For example, the present invention is also applicable to an image forming apparatus structured so that the shutter of its fixing apparatus 18 is in the adjacencies of the recording-medium outlet of the fixing apparatus 18 (downstream end of recording-medium, passage in fixing apparatus 18 in terms of recording-medium conveyance direction), and an image forming apparatus structured so that its fixing apparatus 18 has two shutters which are in the adjacencies of the recording-medium entrance and outlet, one for one, of the fixing apparatus 18.

Also in this embodiment, the fixing apparatus 18 was for a monochromatic laser printer. However, the application of the present invention is not limited to fixing apparatuses which are the same as, or similar to, the fixing apparatus in this embodiment. That is, the present invention is also applicable to image forming apparatuses other than the one in this embodiment. For example, it is also applicable to a color laser printer or the like.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 035532/2010 filed Feb. 22, 2010 which is hereby incorporated by reference.

What is claimed is:

1. A fixing apparatus for fixing an image formed on a recording material, said fixing device comprising:

a guiding member configured to guide movement of the recording material, provided in a recording-material passing opening of said apparatus;

a rib projecting from a recording material passing surface of said guiding member, configured to be contacted by the recording material;

a shutter provided at a position opposing said guiding member and movable between a position for opening the recording-material passing opening and a position closing the recording-material passing opening; and a projection provided at a position of said shutter opposing a portion of said guiding member not having said rib with respect to a direction perpendicular to a recording-material feeding direction, wherein when said shutter takes the closing position, the clearance between said rib and said shutter is larger than the clearance between said guiding member and said projection.

2. An apparatus according to claim 1, further comprising a positioning portion, provided outside of a recording-material passing region with respect to the direction perpendicular to the recording-material feeding direction, for positioning said shutter when said shutter is takes the closing position.

* * * * *